United States Patent [19]

Gal et al.

[11] Patent Number: 5,030,158

[45] Date of Patent: Jul. 9, 1991

[54] OPTICAL CONSTRUCTION TOY

[76] Inventors: Eli Gal, 8 Albert Lane, Ramat Gan; Dan Moran, 19 Aluf David Street, Ramat Chen; Yonatan Gerlitz, 23 Malchei Israel Street, Herzlia; Roni Raviv, 9A/8 Maccabi Street, Ness Ziona, all of Israel

[21] Appl. No.: 477,449

[22] Filed: Feb. 6, 1990

[51] Int. Cl.[5] ..... A63H 33/08

[52] U.S. Cl. ..... 446/128; 446/108; 446/219; 350/507; 350/96.2; 350/96.15

[58] Field of Search ..... 350/507, 96.2, 96.15; D16/100, 131; 446/108, 128, 219, 118; 434/303

[56] References Cited

U.S. PATENT DOCUMENTS

| | | | |
|---|---|---|---|
| 1,521,339 | 12/1924 | Taylor | 434/303 |
| 1,889,284 | 1/1931 | Hankel | 350/507 |
| 3,535,817 | 2/1967 | Fischer | 446/219 |
| 4,132,028 | 1/1979 | Ogawa | 446/219 |
| 4,911,673 | 3/1990 | Hollowell | 446/219 |

*Primary Examiner*—Robert A. Hafer
*Assistant Examiner*—David Kenealy
*Attorney, Agent, or Firm*—Abelman Frayne Rezac & Schwab

[57] ABSTRACT

An optical construction toy assembly including modular optical apparatus having optical power and construction apparatus for permitting selectable arrangement of the modular optical apparatus having optical power to selectably define a plurality of different optical devices.

10 Claims, 5 Drawing Sheets

OPTICAL CONSTRUCTION TOY

FIELD OF THE INVENTION

The present invention relates generally to toy optical instruments.

BACKGROUND OF THE INVENTION

Various types of toy optical instruments are known in the art. Generally speaking, they are all dedicated to a given optical device, such as a microscope or telescope, and are presented in a kit form intended for the user to construct the given optical device.

Applicants are not aware of the existence of any construction toy in which optical elements are included among the modular building blocks, enabling the optical elements to be used to construct any one of a variety of optical devices.

SUMMARY OF THE INVENTION

The present invention seeks to provide an improved optical construction toy which can be used to construction a variety of optical devices.

There is thus provided in accordance with a preferred embodiment of the present invention an optical construction toy assembly including modular optical apparatus having optical power and construction apparatus for permitting selectable arrangement of the modular optical apparatus having optical power to selectably define a plurality of different optical devices.

In accordance with a preferred embodiment of the present invention the apparatus for permitting selectable arrangement comprises elements of an interlocking construction block assembly, such as Lego R, Superblocks R of Tyco or the like.

In accordance with a preferred embodiment of the invention, the modular optical apparatus may comprise lenses, prisms, mirrors, apertures, prism clusters, curved mirrors and the like which are preferably arranged in a modular mounting housing to permit ready interchangeability.

In accordance with a preferred embodiment of the present invention, the apparatus for permitting selectable arrangement may comprise movable elements of an interlocking constructions block assembly, such as hinges, pivots, pistons and the like.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

The present invention seeks to provide an assembly toy including modular optical elements which can be combined and arranged to enable construction of a variety of optical devices. Preferably, in accordance with a preferred embodiment of the present invention, the assembly toy is of the interlocking block type, sold under the trademark Lego R or the trademark Superblocks R.

Figure 1B:
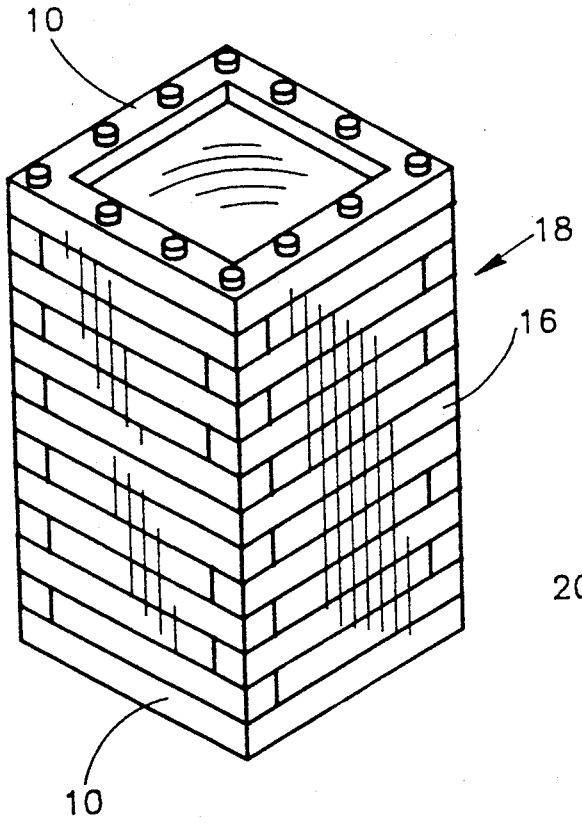
FIGS. 1A and 1B are pictorial illustrations of a simple, hand-held pocket microscope constructed and operative in accordance with a preferred embodiment of the invention in respective exploded view and assembled orientations.
Figure 1A:
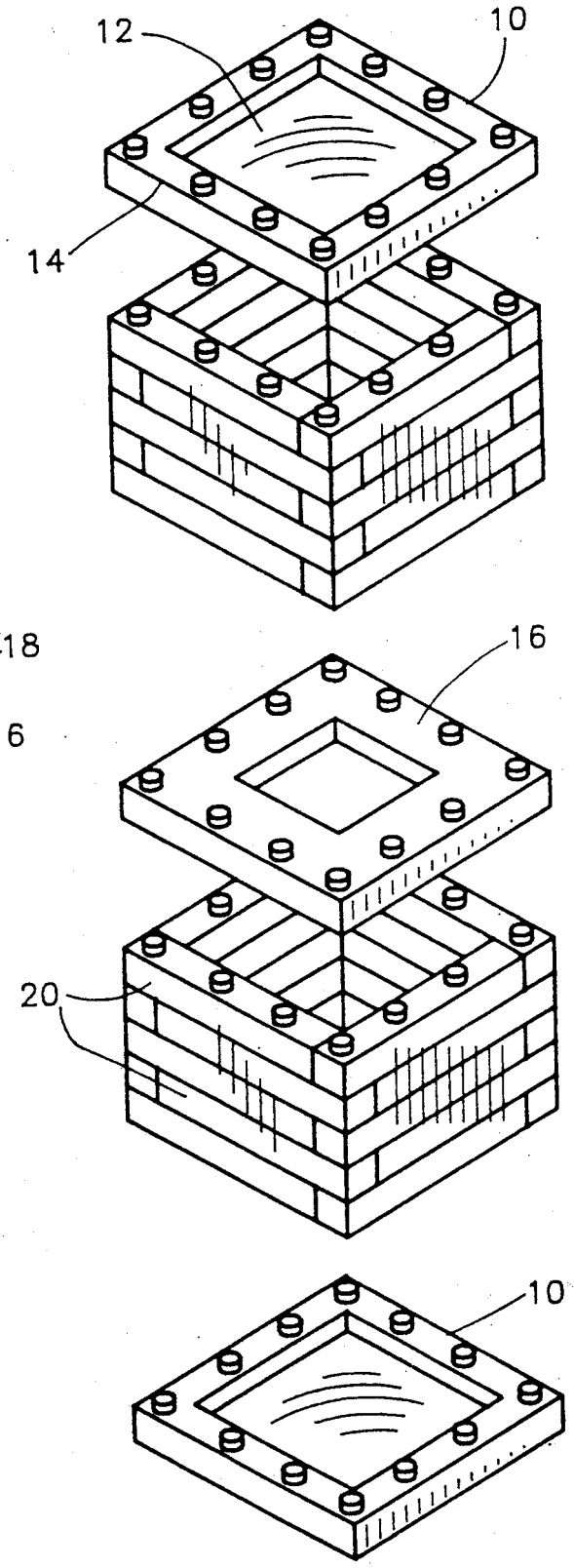

Reference is now made to FIGS. 1A and 1B which illustrate a simple, hand-held, pocket microscope, constructed and operative in accordance with a preferred embodiment of the invention. It can be seen that a modular lens element 10, typically comprising a lens portion 12, fixedly mounted in or integrally formed with a frame 14, which is formed to have an interlocking block configuration, is employed both at the top and the bottom of the hand held microscope. Normally the focal lengths of the two modular lens elements 10 employed in the pocket microscope are different.

An aperture defining element 16 is defined at a location intermediate a hollow column 18, formed by interlocking conventional elongate interlocking blocks 20, as seen in FIG. 1B.

Figure 2:
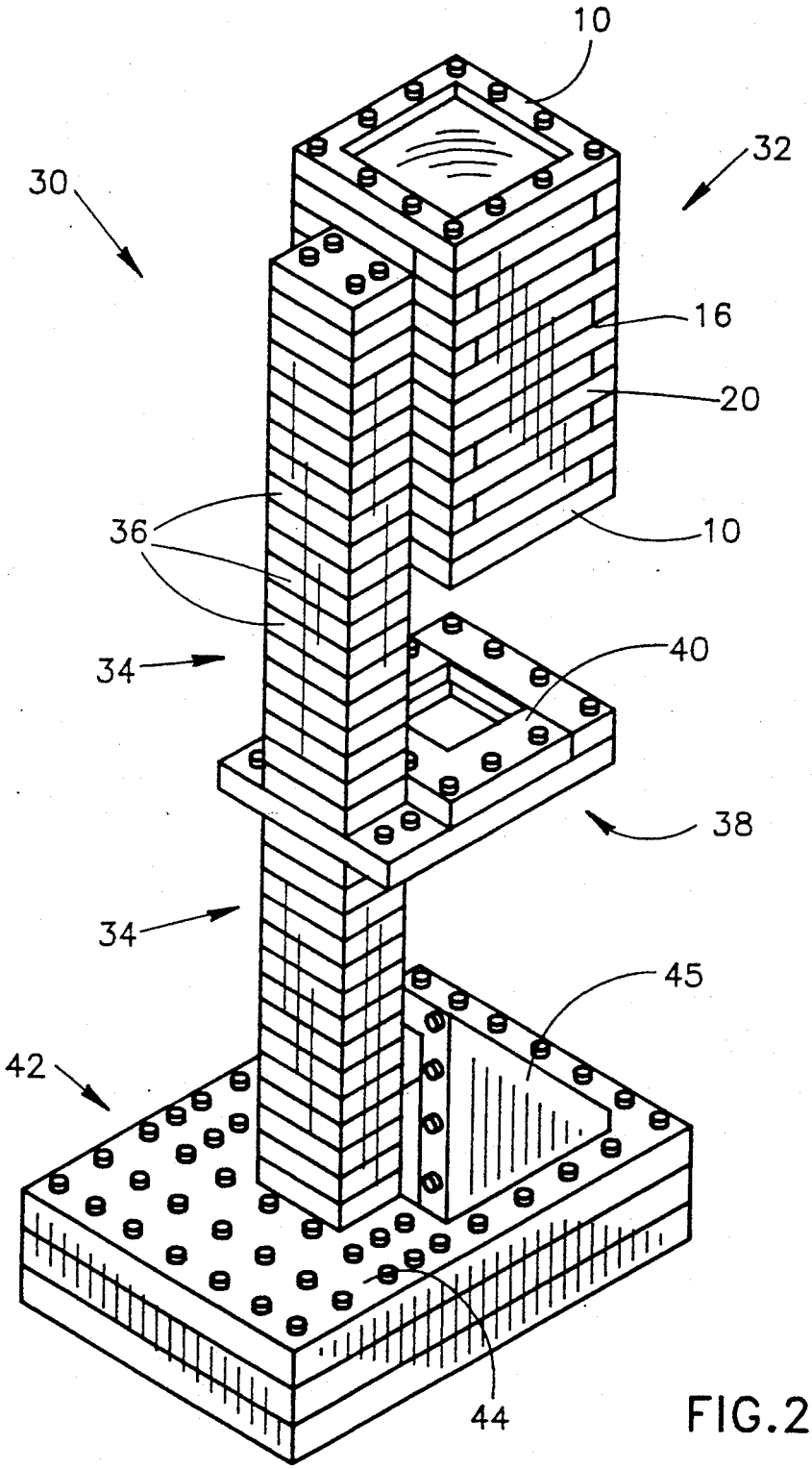
FIG. 2 is a pictorial illustration of a microscope constructed and operative in accordance with a preferred embodiment of the invention.

Reference is now made to FIG. 2, which illustrates a microscope 30 formed of interlocking blocks of the type employed in FIGS. 1A and 1B. Here a modular lens element 10 is mounted on the top of a hollow column 32 of conventional elongate interlocking blocks 20 to define the ocular. Another modular lens element 10 is mounted on the bottom of column 32 to define the objective lens. Normally, the focal lengths of the two lens elements 10 are different.

Column 32 is supported on a stack 34 of interlocking blocks 36, which also interlock with blocks 20 to integrally join the stack 34 with column 32. Mounted onto stack 34 is a stage 38 for supporting a specimen to be examined. The stage 38 may incorporate a small aperture defining element 40, as illustrated. It is appreciated that the stage may be selectably positioned with respect to the objection lens.

Stack 34 is typically supported on a base 42, typically formed of a short stack of large interlocking building blocks 44. Preferably supported on base 42, in optical communication with stage 38 and aperture defining element 40 is an angled mirror element 45.

Figure 3A:
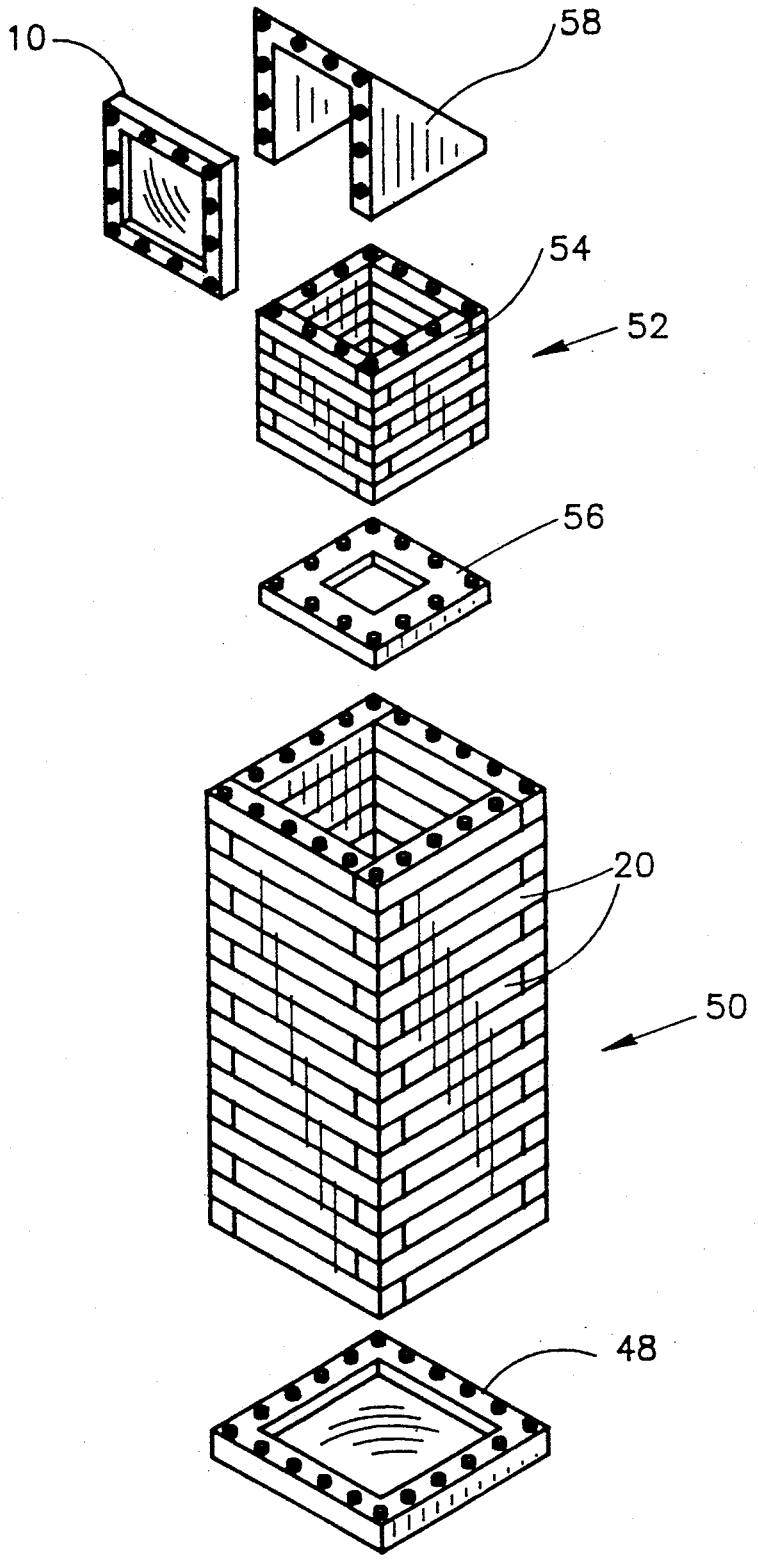
FIGS. 3A and 3B are pictorial illustrations of an elbow, selectable focus telescope constructed and operative in accordance with a preferred embodiment of the invention in respective exploded view and assembled orientations.
Figure 3B:
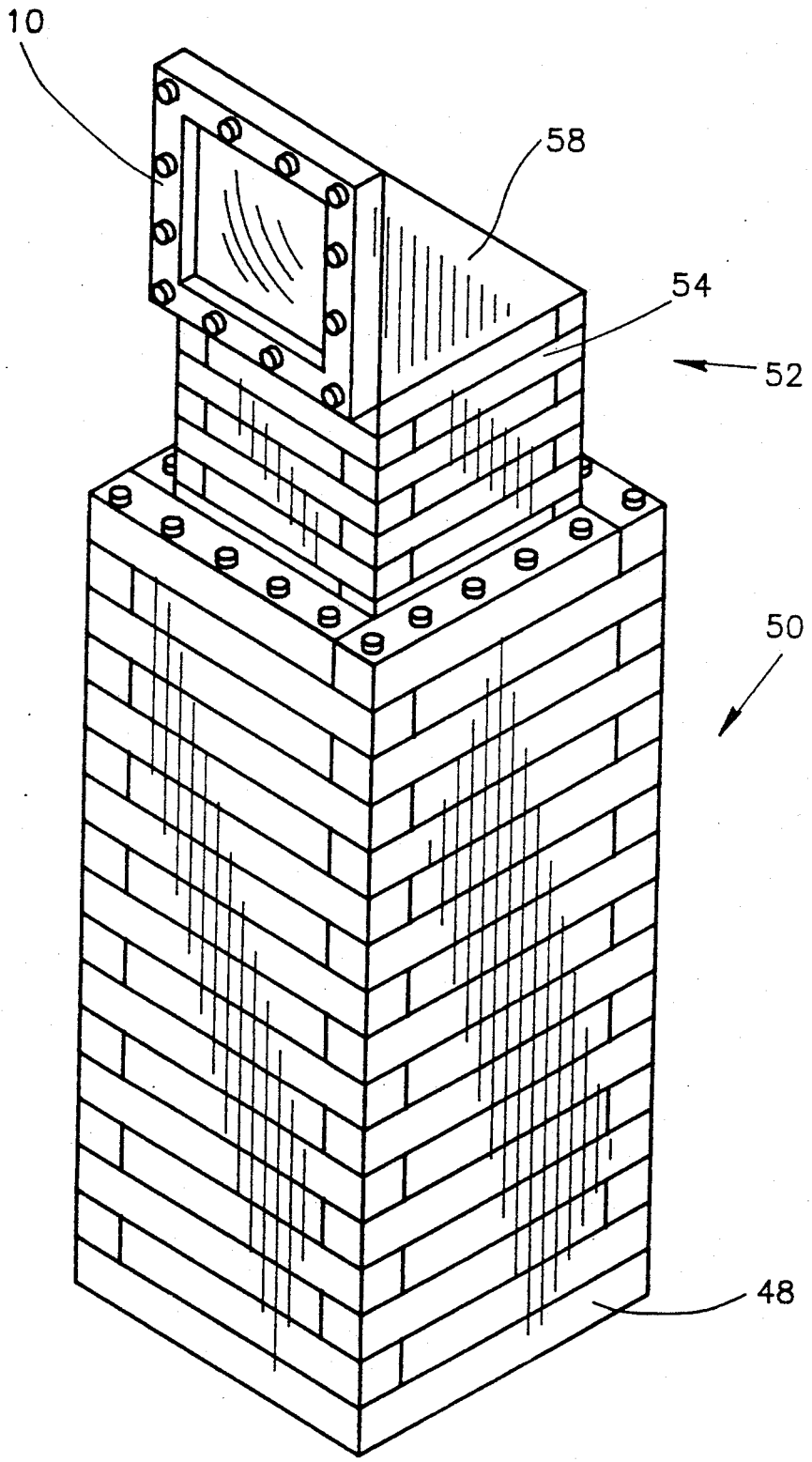

Reference is now made to FIGS. 3A and 3B, which illustrate an elbow, selectable focus telescope constructed and operative in accordance with a preferred embodiment of the present invention. A modular lens element 48 is provided at the end of a telescope tube 50 formed by a hollow interlocking stack of conventional elongate interlocking building blocks 20.

Slidably disposed within telescope tube 50 is an ocular tube 52, typically formed of a hollow interlocking stack of conventional elongate interlocking building blocks 54, which are shorter than blocks 20, so as to enable tube 52 to slide within tube 50. At the end of tube 52 facing the objective lens, there is provided a small aperture defining element 56. At the opposite end of tube 52 there is provided an angled mirror element 58 and an ocular lens defined by a modular lens element 10.

Figure 4A:
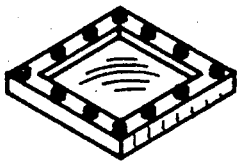
FIGS. 4A, 4B, 4C, 4D, 4E, 4F and 4G are pictorial illustrations of modular optical elements useful in the apparatus of the present invention.
Figure 4B:
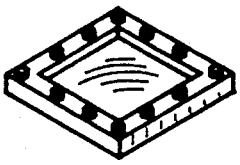

Reference is now made to FIGS. 4A–4G, which illustrate a collection of modular optical elements which can readily be combined with existing interlocking blocks to enable construction of optical devices as illustrated in FIGS. 1A-3B. FIG. 4A illustrates a relatively small lens element, such as lens element 10 described above having a first focal length. FIG. 4B illustrates another lens element, similar to element 10 but having a second focal length which is different from the first focal length.

Figure 4C:
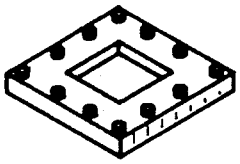
Figure 4D:
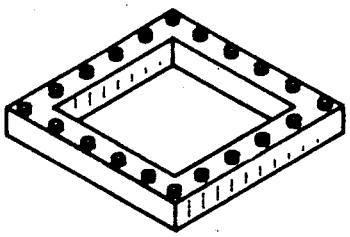
Figure 4E:
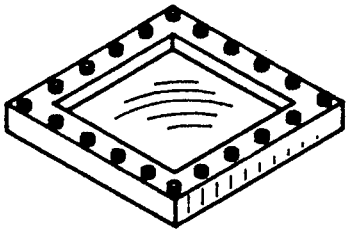
Figure 4G:
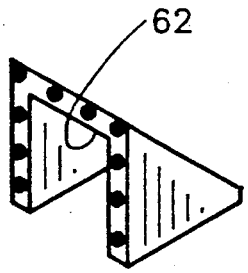
Figure 4F:
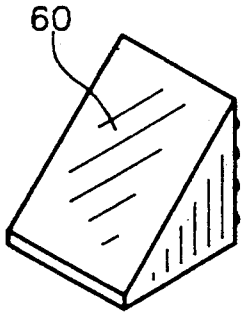

FIGS. 4C and 4D illustrate two different sizes of aperture defining elements. FIG. 4E illustrates a relatively large lens element, such as element 48 described above. FIGS. 4F and 4G illustrate two configurations of angled mirrors, the embodiment of FIG. 4F, including a reflecting outer surface 60 and the embodiment of FIG. 4G including a reflecting inner surface 62.

It will be appreciated by persons skilled in the art that the present invention is not limited by what has been particularly shown and described hereinabove. The devices illustrated and the optical elements described are for purposes of illustration only and it is appreciated that various other modular optical elements may be employed in connection with any suitable assembly toy, which may have various other moving or movable parts which have not been described herein. The present invention is defined only by the claims which follow:

We claim:

1. An optical construction toy assembly including a plurality of modular optical elements, each comprising an optical portion fixedly attached to a frame which is formed to have an interlocking block configuration, said plurality of modular optical elements being arrangeable to selectably define a plurality of different optical devices.

2. An optical construction toy assembly according to claim 1 and also comprising construction apparatus comprising elements of an interlocking construction block assembly, which are arrangeable together with said modular optical elements in interlocking engagement to selectably define said plurality of different optical devices.

3. An optical construction toy assembly according to claim 1 and wherein said optical portion is selected from the group consisting of lenses, prisms and mirrors.

4. An optical construction toy assembly according to claim 2 and wherein said optical portion is selected from the group consisting of lenses, prisms and mirrors.

5. An optical construction toy assembly according to claim 1 and wherein said optical portion is integrally formed with said frame.

6. An optical construction toy assembly according to claim 2 and wherein said optical portion is integrally formed with said frame.

7. An optical construction toy assembly according to claim 3 and wherein said optical portion is integrally formed with said frame.

8. An optical construction toy assembly according to claim 4 and wherein said optical portion is integrally formed with said frame.

9. An optical construction toy assembly according to claim 1 and wherein said optical portion comprises a lens.

10. An optical construction toy assembly according to claim 2 and wherein said optical portion comprises a lens.

* * * * *